US010512811B2

(12) United States Patent
Barber

(10) Patent No.: US 10,512,811 B2
(45) Date of Patent: Dec. 24, 2019

(54) FITNESS TRAINING EQUIPMENT AND METHOD OF USE

(71) Applicant: Matthew Barber, Wauwatosa, WI (US)

(72) Inventor: Matthew Barber, Wauwatosa, WI (US)

( * ) Notice: Subject to any disclaimer, the term of this patent is extended or adjusted under 35 U.S.C. 154(b) by 196 days.

(21) Appl. No.: 15/543,450

(22) PCT Filed: Jan. 13, 2016

(86) PCT No.: PCT/US2016/013253
§ 371 (c)(1),
(2) Date: Jul. 13, 2017

(87) PCT Pub. No.: WO2016/115254
PCT Pub. Date: Jul. 21, 2016

(65) Prior Publication Data

US 2018/0008857 A1 Jan. 11, 2018

Related U.S. Application Data

(60) Provisional application No. 62/102,913, filed on Jan. 13, 2015, provisional application No. 62/218,461, filed on Sep. 14, 2015.

(51) Int. Cl.
*A63B 21/00* (2006.01)
*A63B 69/00* (2006.01)
(Continued)

(52) U.S. Cl.
CPC .. *A63B 21/00065* (2013.01); *A63B 21/00072* (2013.01); *A63B 21/00178* (2013.01);
(Continued)

(58) Field of Classification Search
CPC ..... A63B 21/00065; A63B 21/00072; A63B 21/00178; A63B 21/4009; A63B 21/4011; A63B 21/4034; A63B 21/4031; A63B 21/0557; A63B 21/0428; A63B 23/0222; A63B 23/0429; A63B 69/0059; A63B 2069/0062; A63B 2208/0247; A63B 2210/50
See application file for complete search history.

(56) References Cited

U.S. PATENT DOCUMENTS 6,042,523 A * 3/2000 Graham ..... A63B 21/0552 482/121
D473,272 S * 4/2003 Heins
(Continued)

FOREIGN PATENT DOCUMENTS

JP 1136677 5/1989
JP 1192371 8/1989
(Continued)

*Primary Examiner* — Megan Anderson
(74) *Attorney, Agent, or Firm* — Boyle Fredrickson S.C.

(57) ABSTRACT

An exercise apparatus for targeting the hip muscles is disclosed. The apparatus consists of a plurality of supports, a footboard, and a belt wherein elastic bands may be attached to the belt and to the base supports to provide resistance. The apparatus is fully adjustable for targeting muscles of interest, and collapsible for ready transport. Adjustable handles are optionally provided to maintain user stability and thus maximize the effectiveness of the exercise. A method of using the exercise equipment is also provided.

19 Claims, 5 Drawing Sheets

(51) Int. Cl.

| | |
|---|---|
| ***A63B 21/055*** | (2006.01) |
| ***A63B 23/02*** | (2006.01) |
| ***A63B 23/04*** | (2006.01) |
| ***A63B 21/04*** | (2006.01) |

(52) U.S. Cl.
CPC ..... *A63B 21/0428* (2013.01); *A63B 21/0557* (2013.01); *A63B 21/4009* (2015.10); *A63B 21/4011* (2015.10); *A63B 21/4031* (2015.10); *A63B 21/4034* (2015.10); *A63B 23/0222* (2013.01); *A63B 23/0429* (2013.01); *A63B 69/0059* (2013.01); *A63B 2069/0062* (2013.01); *A63B 2208/0247* (2013.01); *A63B 2210/50* (2013.01)

(56) References Cited

U.S. PATENT DOCUMENTS

| | | | | |
|---|---|---|---|---|
| 8,939,872 | B2 * | 1/2015 | Sprague | A63B 21/00047 297/423.1 |
| 9,782,622 | B2 * | 10/2017 | Hornback | A63B 23/0482 |
| 2012/0190511 | A1 | 7/2012 | Sprague | |
| 2012/0202654 | A1 | 8/2012 | Contreras | |

FOREIGN PATENT DOCUMENTS

| | | |
|---|---|---|
| JP | 5245229 | 9/1993 |
| JP | 2006217933 | 8/2006 |
| JP | 2009247839 | 10/2009 |
| JP | 2014193413 | 10/2014 |

* cited by examiner

FITNESS TRAINING EQUIPMENT AND METHOD OF USE

CROSS-REFERENCE TO RELATED APPLICATIONS

This application claims priority to U.S. Provisional Patent Application No. 62/102,913, filed Jan. 13, 2015, entitled Fitness Training Equipment and Method of Use, and U.S. Provisional Patent Application No. 62/218,461, filed Sep. 14, 2015, entitled Fitness Training Equipment and Method of Use-Part II. The subject matter of these applications is hereby incorporated by reference in their entirety.

BACKGROUND OF THE INVENTION

Field of the Invention

The preferred embodiments are directed to exercise and fitness equipment, and more particularly to exercise and fitness equipment designed to help a user target the gluteal/hip muscles.

Discussion of the Related Art

Existing exercise and fitness equipment designed to target the gluteal/hip muscles (sometimes referred to herein as the "gluteus maximus" or "glutes") is not designed for ease of use, and rarely offers portability; rather, known methods typically employ permanent gymnasium equipment. Furthermore, existing thrust exercises for strengthening the gluteal/hip muscles often rely on the use of weights, generally held across the hips, or elevating the individual using a conventional bench and bar. Holding the weight across the hips while simultaneously raising the hips to perform the exercise has the effect of making the weight unstable and creates a danger to the person performing the exercise.

Furthermore, existing equipment and exercises typically cause strain on the person's lower back and knees because the person must support himself above the ground while performing the exercise. Examples of such exercises include squats, lunges, and deadlifts. Moreover, current equipment and exercises do not target the gluteal/hip muscles as effectively as desired. In addition, the cost of much of the existing non-portable equipment is prohibitively expensive, making it extremely difficult for an average person to purchase a piece of equipment to target this high interest region of the body.

Therefore, there was a need for a piece of exercise equipment specifically designed to target the gluteal muscles, with a corresponding method that is simple enough to allow an exercise novice to perform the exercises correctly. Additionally, an apparatus was desired that does not create additional danger for the user by requiring the use of additional free weights, or elevation of the entire body above the floor. Exercise equipment that eliminates the strain on the lower back and knees caused by current methods of exercising the gluteal muscles was also desired. Preferably, the design would be portable and cost effective enough to use the equipment anywhere and on a daily basis if desired.

SUMMARY AND OBJECTS OF THE INVENTION

A primary object of the preferred embodiments is to provide an easy-to-use exercise apparatus designed to target the gluteal/hip muscles, as well as a corresponding method for using the apparatus.

It is another object of the invention to provide a piece of exercise equipment that couples the user's bodyweight with resistance provided by elastic bands to most effectively target the gluteal/hip muscles, thus eliminating the need for additional external weights.

It is yet another object of the invention to provide a piece of exercise equipment and method for use thereof that reduces the strain on the user's lower back and knees.

It is yet another object of the invention to provide a piece of exercise equipment for the above purposes that is portable and may be collapsed for easy storage when not in use.

It is a further object of the invention to provide a piece of exercise equipment designed to target the gluteal/hip muscles that is cost effective to produce and purchase.

According to one aspect of the preferred embodiments, a piece of exercise equipment in accordance with the present invention includes: a footboard; a plurality of supports; a hip belt with attached elastic bands and ready disconnects for ease of use; and preferably, a pair of handles. A pair of base supports lie on the floor when the device is in use, with other supports extending at angles therefrom. The base support includes a pivot point, at which the front footboard support is rotatably attached. A handle is attached to one end of each base support, such that a user may grasp the pair of handles for additional support when performing the exercise. Along the outside face of each base support is a plurality of holes. A movable retainer or mounting device (e.g., a j-bolt) is engageable with these holes, with the location of the j-bolt being variable along the base support. The j-bolt allows the user to attach and secure the elastic resistance bands to the base support, thus providing resistance while performing the exercise.

Furthermore, arranged perpendicularly between the pair of base supports is a series of circular bars. The front footboard support extends from the base support at an angle and allows the footboard to be positioned such that the face of the footboard faces the user. A rear support or brace attaches to the rear face of the footboard and comprises two vertical pieces and a horizontal brace piece attached thereto opposite the footboard. The brace has a pair of cutouts near the attachment points to the vertical pieces such that it is able to engage with the bars disposed between the base supports, thereby providing support and stabilization of the footboard. In addition to the above described unit, the user is provided with a hip belt. Each end of the hip belt is attached to at least one elastic resistance band. The elastic resistance bands may then be attached to the base support by way of a movable j-bolt described above. The hip belt may be made of nylon or similar material and contains a buckle or similar fastening device, such that the belt may be fastened across a user's hips. In one alternative, each end of the hip belt may include a hook, clamp, or clip that allows the elastic band to be removed from the belt and replaced with an elastic band having different properties (e.g., a different resistance amount, etc.)

To perform the exercise, the user first positions the footboard at a comfortable angle by rotating the front footboard support. Once the user is satisfied with the position of the footboard, he may secure it by engaging the footboard support with one of the corresponding bars located between the base supports. With the chosen elastic bands attached to the hip belt, the user may move the j-bolts between the holes along the base support and then attach the elastic bands thereto. The user will then lay on the ground facing the equipment and buckle the hip belt across his hips, adjusting the length as needed. The user then grabs the handles. The user will then position his feet on the footboard such that his hips are at an angle of approximately 90° and raise his hips in a controlled fashion, stopping when his hips are parallel to the footboard. The user will then lower his hips back to the ground. The exercise may be repeated as many times as the user desires.

In another aspect of the preferred embodiments, an exercise apparatus comprises a base including at least two base supports and at least one locking member coupled to the base supports. In addition, an adjustable footboard rotatably connected to the base where the footboard includes a platform is also provided. A footboard support is rotatably coupled to the upper end of the platform. The footboard support also has at least one distal free end configured to maintain an interlocking relationship with the locking member, whereby the locking member corresponds to maintaining the footboard at a selected angle relative to a plane of the base.

In yet another aspect of the preferred embodiments, the exercise apparatus includes at least one locking member that includes locking bars having opposed ends coupled to a respective one of the base supports.

According to a further aspect of the preferred embodiments, the exercise apparatus further includes a belt having a pair of free ends adjustably attached to the apparatus to vary exercise resistance. Furthermore, the base supports have at least two holes, and further include mounting devices adjustably supported by the holes, while the free ends of the belt are adjustably attached to the apparatus using the mounting devices.

In another aspect of the preferred embodiments, the belt comprises at least one resistance band.

According to yet another aspect of the preferred embodiments, the exercise apparatus further comprises at least one handle coupled to at least one of the base supports. Additionally, the handle is adjustably coupled to at least one of the holes of the base supports and secured thereto with a locking mechanism. In an additional aspect of the preferred embodiments, the exercise apparatus further includes at least one peg coupled to the base and the handle includes notches that adjustably mate with the peg. Furthermore, the at least one handle includes left and right handles coupled to each of the base supports, respectively.

In a further aspect of the preferred embodiments, the exercise apparatus includes a band that is placed around the user's legs to increase resistance on different muscles during use of the apparatus.

According to another aspect of the preferred embodiments, an exercise method includes providing a base, a footboard rotatably coupled to the base, and a footboard support rotatably coupled to the footboard. Furthermore, the footboard is adjusted to a desired angle by rotating the footboard support and locking the footboard support to the base. A user prostrates on the same plane as the base plane, in a supine position, and positions at least one foot on the footboard such that the user's lower leg or legs are at an angle approximately 90° to the footboard. The user then raises the hips into a modified bridge position and lowers the hips back into original position, and then repeats raising and lowering of the hips.

In a further aspect of the preferred embodiments, the footboard includes a platform and platform support, where the platform support is rotatably coupled to the base. The user attaches a hip belt to at least one of the base and the platform supports, and places the hip belt over at least one of the user's thighs or hips. Furthermore, the hip belt may include at least one resistance band.

In a further aspect of the preferred embodiments, an exercise apparatus comprises a base including first and second base supports and locking bars disposed between the base supports, in which each base support includes a straight bar and a plurality of holes which are located on an outside face of the straight bar. In addition, each base support includes a pair of bolts, where the bolts are movably engageable with the plurality of holes and at least one handle adjustably coupled to one of the base supports. Each base support further includes a footboard, including a platform and at least one platform support, a footboard support that is rotatably attached to the footboard and includes a pair of support arms. The support arms are rotatably attached to the footboard at a proximal end and each has a concave cutout at a corresponding distal end, where the concave cutouts of each support arm engage with one of the locking bars. Furthermore, each base support includes a pair of handles, each attached to a respective one of the first and second base supports.

In another aspect of the preferred embodiments, a knee band positioned around the user's thighs further targets the user's hips and glutes during use of the exercise apparatus.

According to a further aspect of the preferred embodiments, handles are attached to the base support. The handles fold in for storage and swing out for use. The handles are provided to facilitate maintaining body position during the exercise, as well as the ability to vary the tension of the elastic bands during use, by pushing away to increase tension and pulling closer to decrease tension, thereby maximizing the effectiveness of targeting the muscles of interest. The handles also allow for stability of the apparatus and prevent the apparatus from gradually moving away from the user during use.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

DESCRIPTION OF THE PREFERRED EMBODIMENTS

Figure 1:
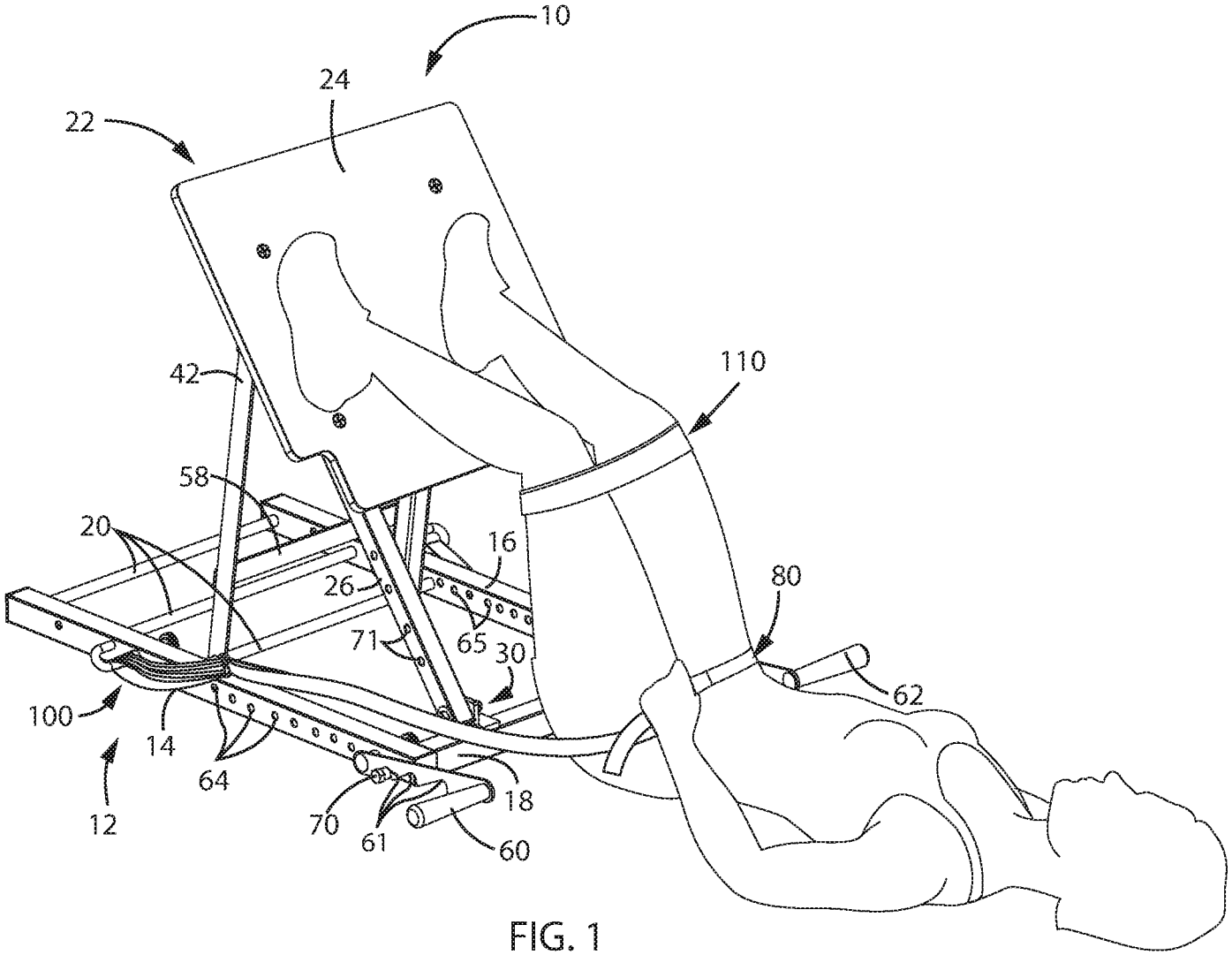
FIG. 1 is an isometric view of an exercise apparatus for strengthening a user's gluteus maximus and hip regions according to a preferred embodiment, showing a user preparing to initiate a glute/hip exercise.

FIG. 1 shows an isometric view of a preferred embodiment of an exercise apparatus 10, including how the exercise unit would be used. A base 12 including a pair of parallel base supports 14, 16 rests on the floor during use. Base supports 14, 16 are coupled to a transverse support 18 at the forward end of apparatus 10, and preferably a plurality of locking members such as bars 20 having opposed ends that are coupled to supports 14, 16 towards the middle and rear of base 12 of apparatus 10. Bars 20 provide further stability to the base 12 and, as described below, allow the angle of the footboard 22 to be adjusted.

Figure 2B:
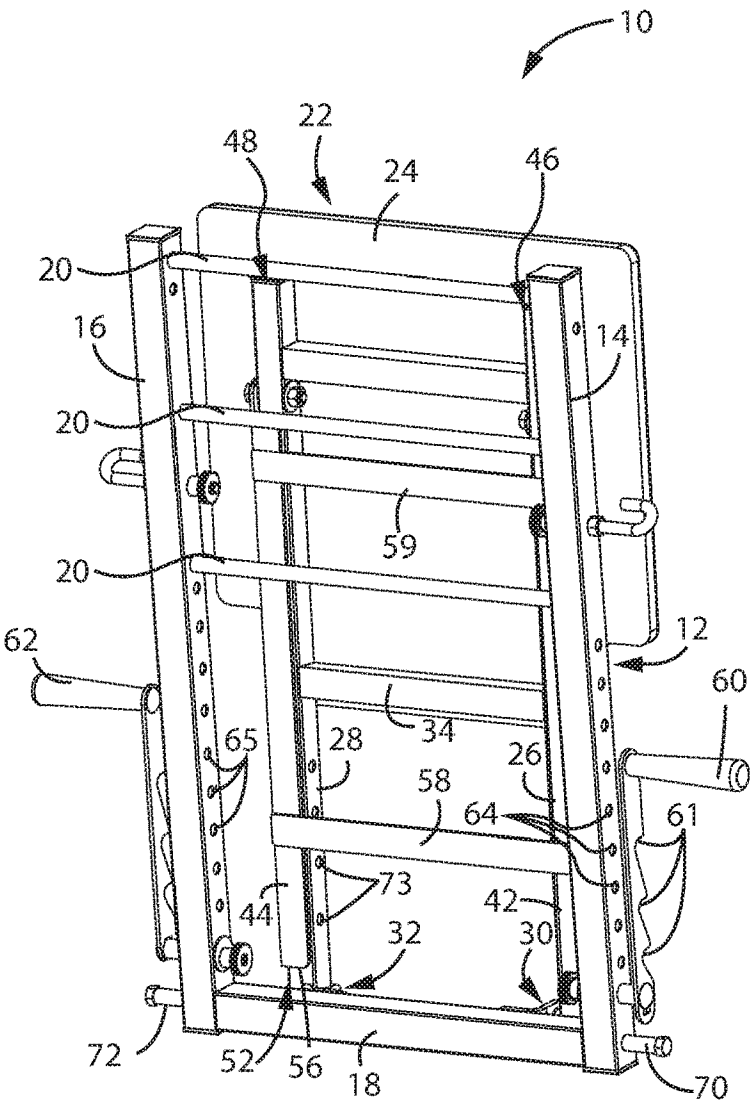
FIG. 2B is an isometric view of the exercise apparatus similar to FIG. 2A, illustrating the apparatus collapsed for storage and transport.
Figure 2A:
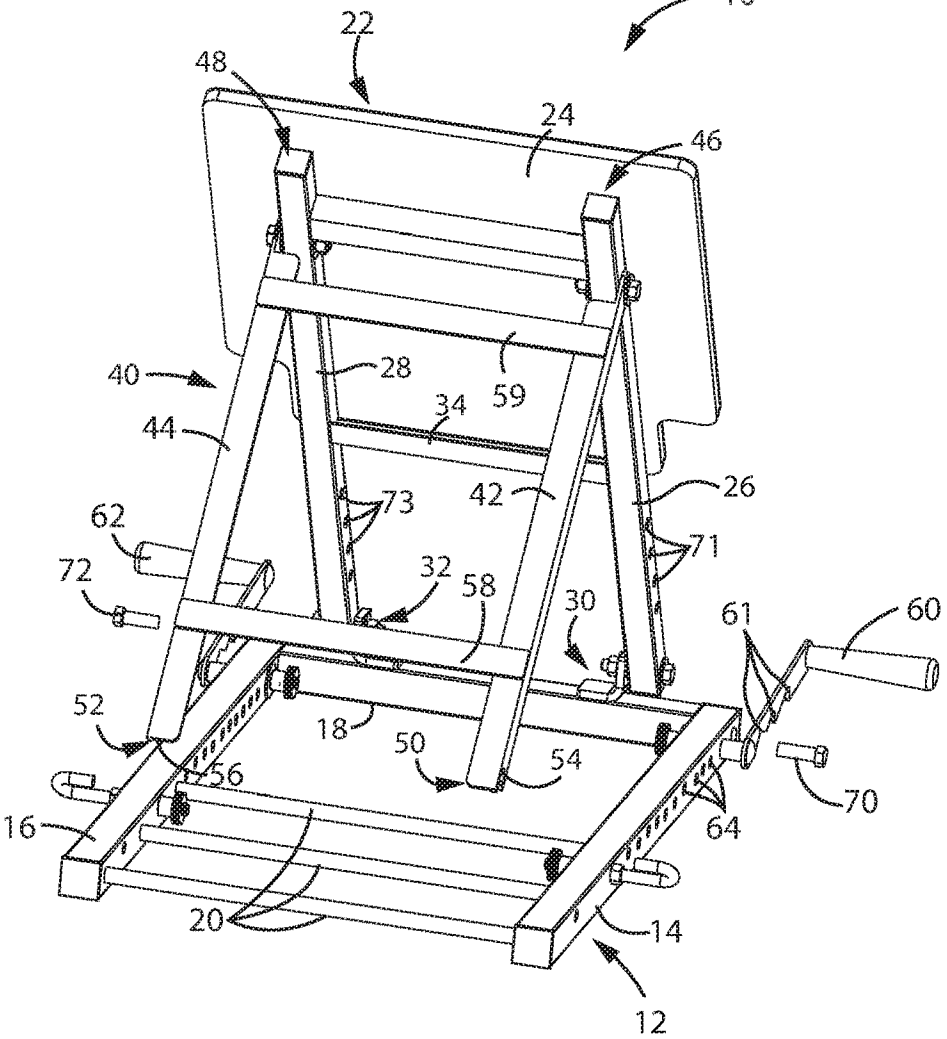
FIG. 2A is an isometric view of the exercise apparatus of FIG. 1, illustrating the adjustability of the foot support.

Referring next to FIGS. 1 and 2A, an adjustable and collapsible footboard 22 includes a platform 24 mounted to a pair of platform supports 26, 28. Supports 26, 28 extend beyond a bottom of platform 24 and include ends 30, 32 that are rotatably coupled to cross support 18 of base 12 (for example, using appropriate hinges). As described further below, this hinged action between footboard 22 and base 12 allows apparatus 10 to be collapsible for ready storage and transport, while also allowing adjustability of the angle of platform 24 (where a user places his/her feet for support) relative to base 12. This affords the user the ability to truly target muscles to be worked. Preferably, footboard 22 also includes a transverse support 34 to provide further stability to the footboard (minimize twisting, etc.).

Continuing with FIG. 2A, to support platform 24 in an angled relationship with base 12, a swinging rear footboard support 40 is rotatably coupled to footboard 22. Footboard support 40 includes a pair of parallel support arms 42, 44 coupled at respective ends 46, 48 to the back of platform 24 in a hinged relationship to the platform 24. At the distal ends 50, 52 of each rear arm 42, 44, respectively, is a female-style slotted or contoured cutout, such that the cutout is able to engage a selected one of the horizontal locking bars 20. The female cutouts 54, 56 are of such a size that rear footboard support 40 is able to securely lock with a locking bar 20 when in use, yet may be readily adjusted to allow for positioning of the angle of platform 24. To provide further stability to footboard support 40, preferably, transverse supports 58, 59 having opposed ends are welded to support arms 42, 44.

In addition, a series of openings or holes 64, 65 are located along the outer side of each base support 14, 16. Corresponding mounting devices, for example, pegs or j-bolts 101, 103, may be movably engaged with openings 64, 65 to provide a place for the opposite ends of a resistance or hip belt 80', including resistance bands, to be attached (see also FIGS. 5A and 5B, and corresponding description). The further back (away from the user) j-bolts 101, 103 are placed the more resistance provided for the same resistance band. Notably, according to an alternative, rather than using holes and j-bolts to accommodate a resistance or hip belt, a weight stack and a cable coupled to a bar positioned around or between the user's upper legs (not shown) could be employed to provide the desired resistance when using apparatus 10.

Referring again to FIGS. 1, 2A and 2B, handles 60, 62 are preferably attached to the forward ends of base supports 14, 16, respectively, closest to the user. Handles 60, 62 facilitate ease of body positioning for the user, proper positioning being important to target the desired muscles (glutes, hips, etc.), and as described below in connection with use of the apparatus shown in FIGS. 5A and 5B, helps the user maintain body position to maximize work of the targeted muscles. Handles 60, 62 lend stability to apparatus 10, allow adjustment of the placement of the unit to facilitate ready clipping/unclipping hip belt 80', allow the tension of the bands to be adjusted during a set (e.g., push away to increase band tension, pull closer to decrease tension), and allow the user to keep the distance between her and the apparatus 10 more consistent. These features are further facilitated by optionally including a series of notches 61 in handles 60, 62 that can engage and lock on to studs or pegs 70, 72 (either fixed or removable and positionable) situated to accommodate the user's preferences (comfort, effort, etc.). Handles 60, 62 have opposed free ends having locking mechanisms 67, 69 (e.g., a stud or bolt with a threaded end that mates with a thumb nut that can be hand tightened to secure the handles to the base). This allows handles 60, 62 to be positioned and locked at selected ones of openings 64, 65, with a corresponding one of notches 61 locking on to handle stops or pegs 70, 72 (preferably secured to base by screwing their threaded ends to the base) at a desired location.

FIG. 2B shows a rear view of the collapsed and folded-exercise apparatus 10. Hinges connecting platform supports 26, 28 of footboard 22 to base 12, and rear support arms 42, 44 to platform 24 may be rotated such that base supports 14, 16, platform supports 26, 28, and rear support arms 42, 44 lie parallel to one another. Any conventional locking mechanism such as an eye hook (not shown) may be employed to secure the rotating sections for storage and transport.

Hip belt 80' allows the user to increase the user's workload when using the apparatus. A resistance band 110 may be incorporated as part of hip belt 80' by means of a hook, clamp, or buckle also accommodating at most minimally elastic fabric straps. The hip belt 80 fastens around the user by means of a second buckle, as described below.

Figure 3A:
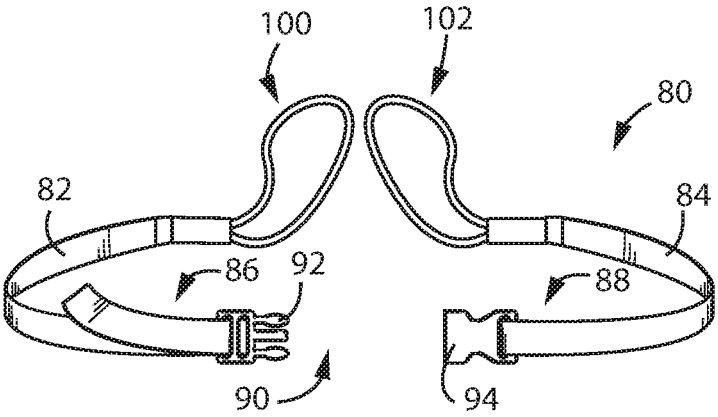
FIGS. 3A & 3B is a front view of the resistance bands of the exercise apparatus of a preferred embodiment, FIG. 3B illustrating the ready disconnect feature.
Figure 3B:
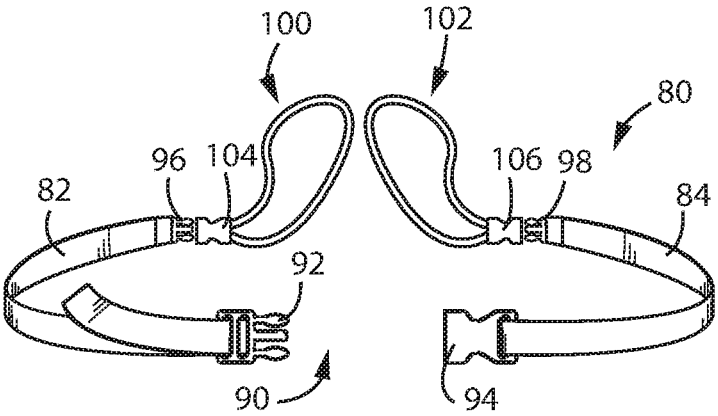
Figure 3C:
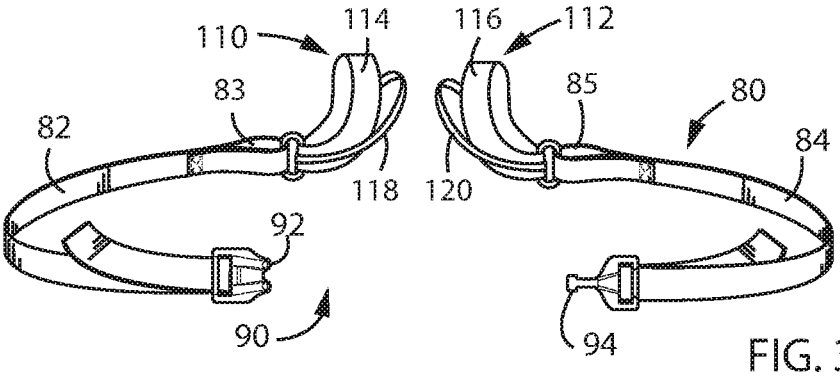
FIGS. 3C & 3D is a front view of the resistance bands of the exercise apparatus of an alternate embodiment, FIG. 3D illustrating an alternate ready disconnect apparatus.
Figure 3D:
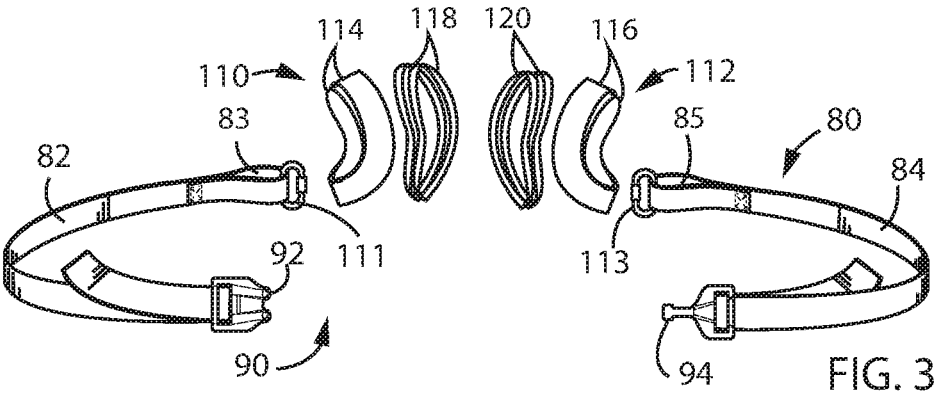

FIG. 3A shows hip belt 80 in detail. Preferably, hip belt 80' is of two piece construction including fabric straps 82, 84 having first ends 86, 88, respectively, supporting a buckle 90 including male 92 and female 94 portions that interlock. Note that while clip connectors are shown, any conventional connector could be employed. Resistance bands 100, 102 are formed in the shape of loops for ready connection to belt hooks, such as j-bolts 101, 103 of apparatus 10. By including buckle 90 as part of hip belt 80', the user can connect the free ends of resistance bands 100, 102 to the j-bolts 101, 103 first (by slipping the loops over j-bolts 101, 103), and then position his/her body prior to clipping the hip belt 80' together using buckle 90—an operation made more difficult without the buckle 90. Alternate belts with bands of varying resistance (for instance, rated in pounds) may be employed to vary tension during exercise. In an alternative shown in FIG. 3B, the opposite ends of straps 82, 84 may include male clip portions 96, 98 for connecting to corresponding female clip portions 104, 106 of resistance bands 100, 102. By including quick disconnect clips (96-104, 98-106) for resistance bands 100, 102, the resistance bands could be swapped for alternate resistance bands based on the amount of resistance the user would prefer. In FIGS. 3C and 3D, an alternate and more preferred version of a hip belt 80' including resistance bands is shown. Resistance bands 110, 112 include elastic bands (114, 116, 118, 120) that may be coupled to links 111, 113 that similarly accommodate looped ends 83, 85 of straps 82, 84. An alternate adjustable buckle 130 is also provided, coupled to the opposite ends of straps 82, 84, including lockable female 132 and male 134 parts. Bands can be replaced for varying resistance, etc., or removed altogether for distraction type exercises (in this case looped ends 83 are placed directly over the J-bolts).

Figure 4:
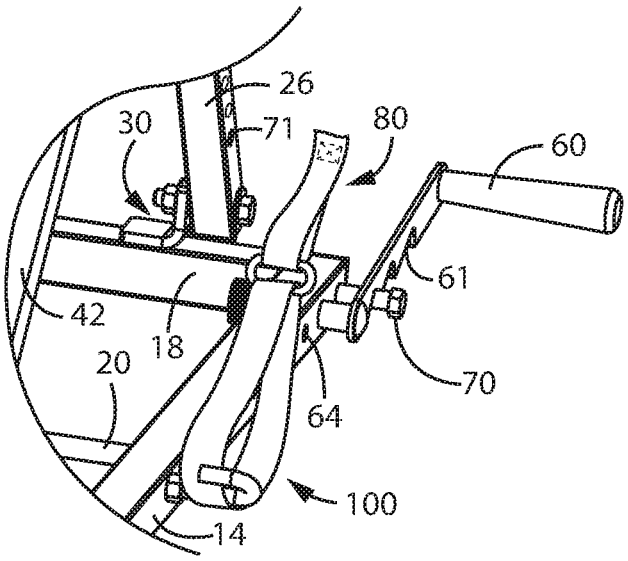
FIG. 4 is partially broken away isometric view of the exercise apparatus of FIG. 1, highlighting the resistance adjustment aspect of a preferred embodiment.

FIG. 4 shows a close-up of the attachment of one of the resistance bands 110 of hip belt 80' connected to base 12 of apparatus 10. Again, j-bolts 101, 103 may be movably positioned within one of a series of holes 64 located along the outer edge of the base supports 14, 16. Once j-bolts 101, 103 have been positioned and secured (for example, using a threaded end sized to mate with holes 64 or 65 and tightened with a thumb nut), resistance bands 110, 112 of belt 80' may be strung over j-bolts 101, 103 so as to secure bands 110, 112 and straps 82, 84 of belt 80' thereto.

Figure 5A:
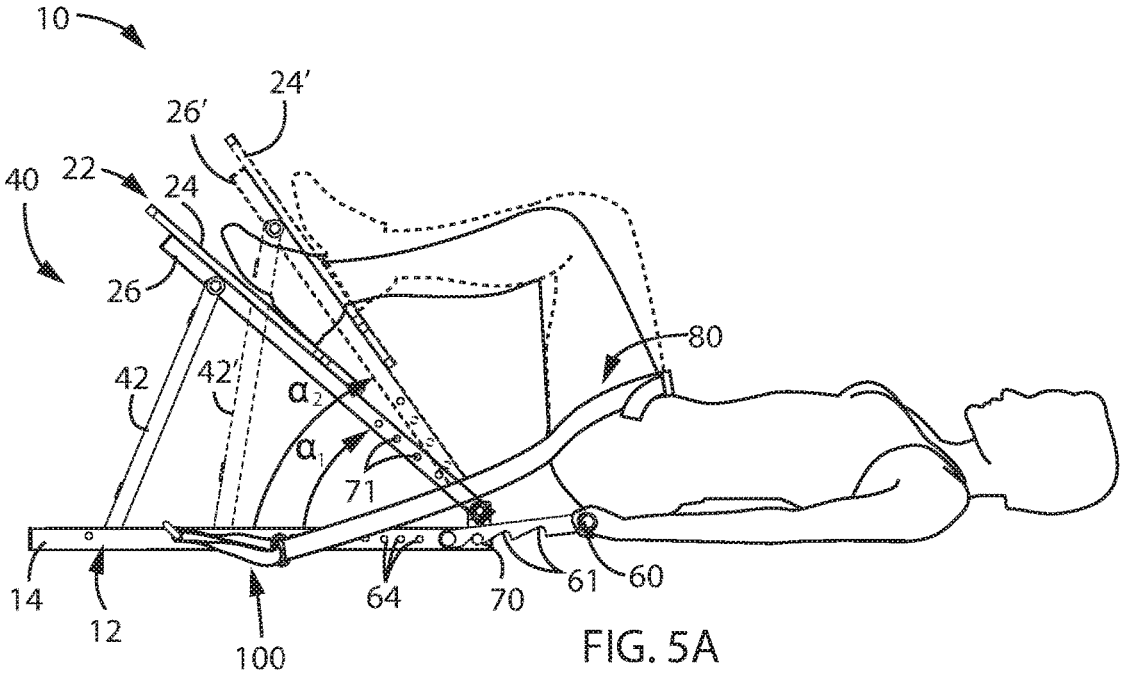
FIG. 5A is a side view of the exercise apparatus of FIG. 1, illustrating a user in a starting position.
Figure 5B:
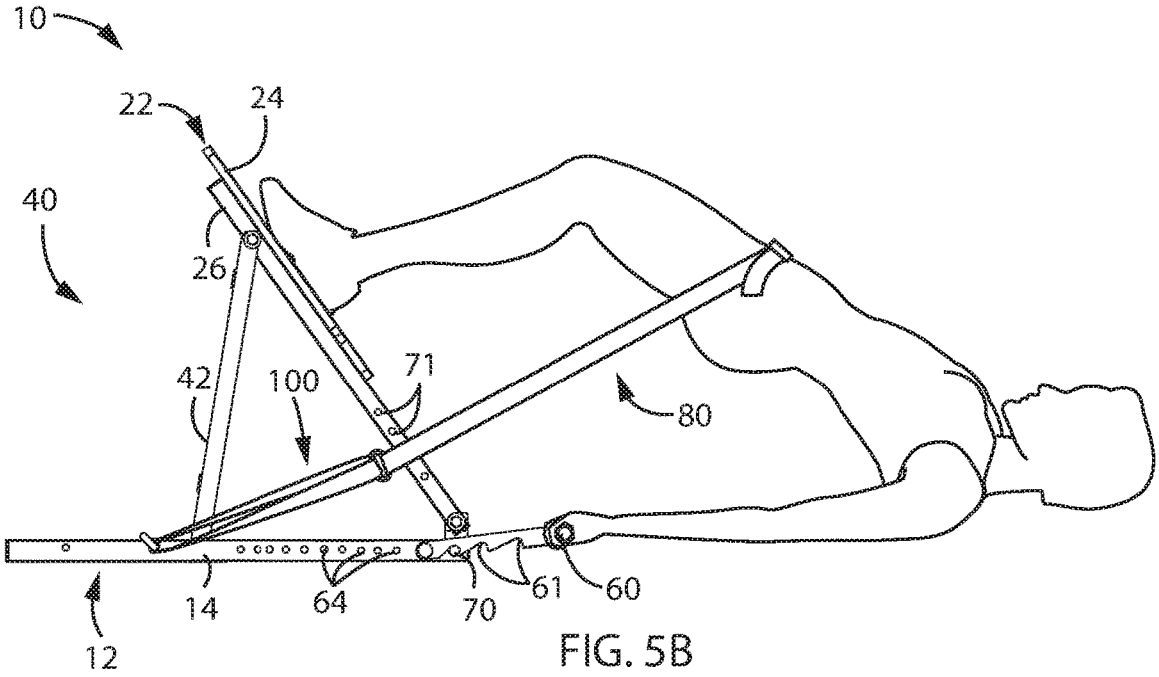
FIG. 5B is a side view of the exercise apparatus of FIG. 1, illustrating a user in an active/extended position.

Turning to FIGS. 5A and 5B, use of apparatus 10 is illustrated. FIG. 5A shows the beginning position of a user about to initiate exercising with apparatus 10. In this position, the user has adjusted the position of footboard 22 relative to base 12 to an angle, $\alpha_1$. To bring the user's feet more upright and closer to the user's hips (depending on the flexibility and/or size of the user), footboard 22 is adjusted so that the footboard-to-base position is at an angle, $\alpha 2$, whereby platform support 26 moves to a more upright position (referenced as 26') and rear support arm 42 moves to a more upright position (referenced as 42'). Again, this is accomplished by appropriately positioning footboard support 40 at a locking bar 20 closer to the user. To maximize the effect of apparatus 10, the user wants to adjust the angle of footboard 22 so that s/he can get as close to apparatus 10 as possible, while maintaining a flat back on the floor at the beginning position. This maximizes difficulty by decreasing hip angle and thus increasing the range of motion for the exercise. In the end, the user wants to keep comfort and "feel" of the exercise in mind (being mindful of the feel and effect of the muscles being worked) while making this adjustment.

In most cases, the user will adjust footboard 22 to a comfortable angle (based on the user's size, etc.) and then positions the resistance band on j-bolts 101, 103 along base 12. The user then lies on the floor positioning her hands at about the handles and buckles hip belt 80' across her hips/upper thighs. The feet are positioned on the footboard such that the user's hips are at an angle of approximately 90° relative to her upper torso. As an alternative, j-bolts 101, 103 may be placed in openings 71, 73 along supports 26, 28 to accommodate hip belt 80' being placed to facilitate allowing the user to work different angles/exercises.

FIG. 5B shows the end position of the exercise associated with apparatus 10. Once in starting position (FIG. 5A), the user grasps handles 60, 62 and then raises his hips, preferably to a straight body position, allowing the resistance band to tighten. The feet are located at the same location on footboard 22 as in the beginning of the exercise. The user's shoulders and head remain on the floor. To complete one repetition of the exercise, the user returns to the position shown in FIG. 5A. Ideally, sets of 10-15 repetitions, with or without holding the extended position, are performed for maximum results. The user may also perform the previous motions using only the left or right leg. This allows the user to isolate each glute/hip. In one example a user may want to do five 2-leg lifts, then three left leg lifts, then three right leg lifts, then back to five 2-leg lifts, then repeat. In addition, handles 60, 62 are also useful if the user would like to re-position the unit during an exercise to ensure proper set-up and technique throughout the exercise.

Overall, handles 60, 62 provide stability, ease of adjusting the machine for set-up and for maintaining body position to ensure the target muscle/muscle group is continually being asked to do the work, again thereby maximizing results. Notably, once the bands and band position are selected, the force is typically not adjustable during the exercise. However, and more preferably, handles 60, 62 allow the position of apparatus 10 to be adjustable by allowing the user to slide apparatus 10 back and forth on the surface it sits before the user puts little, if any, pressure on footboard 22 (e.g., during a repetition). This allows the relative position of the user and apparatus 10 to be set, and changed as often as necessary, thereby providing an efficient way to vary the resistance by increasing or decreasing tension on the band.

Note that a hole (not shown) may be formed in footboard 22 for the user to grip to assist in ease of transport. Additionally, openings 71,73 may be provided for alternate placement of bands 110, 112 (alternatively 100, 102), according to the user's preferences.

Note that "portable" in the present context means collapsible and carryable by anyone (as opposed to, for example, a heavy piece of equipment that might be rollable but not truly transportable for use at remote locations). Ideally, one is able to travel with the apparatus 10.

To further concentrate the exercise on the hips and glutes, an elastic knee band (or a non-elastic strap or belt) 115 (FIG. 1) may be included. Knee band 115 adds resistance so the user works the hip abductors and external rotator muscles. In particular, as the user exerts herself during the exercise, knee band 115 will maintain knee position generally consistent, thereby strengthening abduction. Ideally, the knees and feet should be maintained about the same distance apart—though the knees may finish slightly further apart than the feet when at the top of the movement (abduction). Note that the strength of the band 115 is important insofar as abduction is compromised if the band is so strong that it brings the knees in closer than the width of the user's feet (i.e., working "knock-kneed" is undesirable).

In the end, using apparatus 10 allows the hamstrings to be a bit slack (due to knee bend) thereby allowing the gluteus maximus to do the vast majority of the exercise—the primary driving force behind the preferred embodiments. However, for overall hip health, it is important to work the lateral rotator muscles/abductors of the hips. Knee band 115 around the knees would allow this. In sum, combining band 115 with apparatus 10 in one movement is unique and functional for total hip/glute health, with added intensity, especially at the top extended part of the movement, employing far more muscles.

Exercises

The preferred embodiments described herein afford a compact, portable package, a wide range of versatility in both the number of muscles worked, and the types of exercises that a user may perform in. The effectiveness in working a variety of muscles and groups of muscles is thereby maximized.

With respect to single-leg exercises, a single-leg hip extension belt is placed at the hips. Single leg hip extensions with abduction can also be accomplished with the belt at the hips and the band or rigid strap at the user's knees. A single-leg hip lift with anterior elevation of the pelvis is performed with the band at the hips. Using the right leg, the user slightly twists the hip to the left, thus leading with the right hip to work the same. Soleus lifts may also be performed with the belt at the hips. While maintaining hip extension, the user rises up and down on the balls of his/her feet. Abduction may be performed with the belt at the hips and the band or rigid strap at the user's knees. While maintaining hip extension, the user can perform repetitions of abduction (in and out with knee).

Double-leg exercises include the following:

Double-leg hip extension (with the belt at the hips).

Double-leg hip extension with abduction where the belt is placed at the hips and the band or rigid strap at the user's knees.

Abduction is performed with the belt at the hips and the band at the user's knees. While maintaining hip extension, the user performs abduction repetitions.

Isometric abduction and adduction can be accomplished with the belt at the hips and a rigid strap at the user's knees with a "NERF" type ball between the knees. In this case, while maintaining hip extension, the user isometrically adducts against the "NERF" ball and alternates with isometric abduction against the rigid strap.

Marching is performed with the belt at the hips, and optionally, with the band at the user's knees. While maintaining hip extension, the user alternately pulls one foot off the footboard in a marching motion bringing the knee towards the user's torso;

Soleus lifts employ the preferred embodiments with the belt positioned at the hips. While maintaining hip extension, the user rises up on the balls of his/her feet.

Distraction exercises can be performed with the preferred embodiments as well, but the set-up is slightly different. In this case, referring to FIGS. 3C and 3D elastic bands 114, 116, 118, 120 are removed from belt 80' and looped ends 83, 85 placed directly on j-bolts 101, 103 shown in FIGS. 2A & 2B. Distraction exercises may include the following:

"Lying" with a rigid belt around the upper part of the user's thigh. With both legs on the platform, the user presses to "distract" the hip joint of the leg with the belt.

"Standing" with a rigid belt around the upper part of the user's thigh. In this exercise, the user stands sideways to the unit, and with the foot of the belted leg on the platform, the user pushes up to "distract" the hip of the belted leg. NOTE: may require a smaller brace arm assembly to lower the foot platform.

In sum, there are two main ways to use the preferred embodiments. 1) With Bands: the user employs a lot of hip movement, up and down, which causes the bands to provide resistance to build muscle. The bands can be switched out and combined to vary tension, etc. 2) Without Bands: the user employs very minimal or zero hip movement. These exercises are typically prescribed to loosen the hip joint (distraction). Little to no elasticity is desired.

Additional exercises may also include the user standing on the preferred embodiments, with the preferred embodiments positioned in a folded flat position. In this arrangement, the preferred embodiments can be used for attaching bands to the body to provide resistance in a variety of lunging, deadlifting and squatting movements (for example, 1-leg (lunge) or 2-legs (squat, deadlift)). Rather than simply standing on a band, the preferred embodiments would make it more stable and allow some varying of the pull angle and resistance. Notably, the above-described exercises can be performed without the hip belt per the user's preferences/goals.

Although the best mode contemplated by the inventors of carrying out the present invention is disclosed above, practice of the present invention is not limited thereto. It will be manifest that various additions, modifications, and rearrangements of the aspects and features of the present invention may be made in addition to those described above, without deviating from the spirit and scope of the underlying inventive concept. The scope of some of these changes is discussed above. For instance, it will be appreciated that additional points of attachment may be provided at various locations on the apparatus frame of the present invention to expand the range of motion and types of exercises that may be performed. Additionally, it will be recognized that, by employment of alternative methods of using the present invention including changing the position of the body relative to the apparatus, the design herein disclosed will be capable of supporting exercises and physical therapy techniques not specifically cited. Further, it will be appreciated that the present invention may be used to exercise a range of body parts in addition to the gluteal/hip muscles such as lifting, pulling, and pushing exercises for the arms, chest, and abdomen. The scope of other changes to the described embodiments that fall within the present invention but that are not specifically discussed above will become apparent from the appended claims and other attachments.

I claim:

1. An exercise apparatus comprising:

a base including at least two base supports and at least one locking member coupled to the at least two base supports;

an adjustable footboard rotatably connected to the base, the adjustable footboard including a platform;

a footboard supports:

a belt including a pair of free ends adjustably attached to the exercise apparatus to vary exercise resistance;

wherein the footboard support is rotatably coupled to an upper end of the platform and wherein the footboard support has at least one distal free end configured to maintain an interlocking relationship with the at least one locking member, wherein the at least one locking member corresponds to maintaining the footboard stationary at a selected angle relative to a plane of the base, and wherein the belt is worn near the user's hips; and wherein the base, the footboard, and the footboard support are fully collapsible so that the exercise apparatus is portable for transport by the user.

2. The exercise apparatus of claim 1, further comprising at least one handle coupled to at least one of the at least two base supports.

3. The exercise apparatus of claim 2, wherein the at least one handle is adjustably coupled to at least one of the at least two holes of the at least two base supports and secured thereto with a locking mechanism.

4. The exercise apparatus of claim 3, further comprising at least one peg coupled to the base, and wherein the at least one handle includes notches that adjustably mate with the at least one peg.

5. The exercise apparatus of claim 4, wherein at least one handle includes left and right handles coupled to each of the at least two base supports, respectively.

6. The exercise apparatus of claim 1, wherein the at least two base supports have at least two holes, and further comprising mounting devices adjustably supported by the at least two holes, and wherein the pair of free ends of the belt are adjustably attached to the exercise apparatus using the mounting devices.

7. The exercise apparatus of claim 6, wherein the mounting devices are J-bolts.

8. The exercise apparatus of claim 1, wherein the at least one locking member includes locking bars having opposed ends coupled to a respective one of the at least two base supports.

9. The exercise apparatus of claim 1, wherein the belt comprises at least one resistance band.

10. The exercise apparatus of claim 1, further comprising a band, wherein the band is placed around a user's legs to increase resistance on different muscles during use of the exercise apparatus.

11. An exercise method comprising the steps of:

providing a base, a footboard rotatably coupled to the base, and a footboard support rotatably coupled to the footboard;

adjusting the footboard to a stationary desired angle by rotating the footboard support and locking the footboard support to the base;

wherein the base forms a base plane relative to a surface on which the base rests; and wherein a user prostrates on the same plane as the base plane, in a supine position, and positions at least one foot on the footboard such that the user's lower leg or legs are at an angle 90° to the footboard, and then raises the user's hips into a modified bridge position and lowers the hips back into original position, and then repeats raising and lowering of the hips; wherein the base, the footboard, and the footboard support are fully collapsible so that the exercise apparatus is portable for transport by the user.

12. The method of claim 11, wherein the footboard includes a platform and at least one platform support, the at least one platform support rotatably coupled to the base.

13. The method of claim 12, further comprising attaching a hip belt to at least one of the base and the platform supports, and placing the hip belt over at least one of the user's thighs or hips.

14. The method of claim 13, wherein the hip belt includes at least one resistance band.

15. The method of claim 11, further comprising:

providing handles adjustably locked to the base; and grasping the handles to minimize sliding of the user on the base plane.

16. The method of claim 11, further comprising positioning a band around the user's legs to increase resistance on different muscles during use of the apparatus.

17. Exercise apparatus comprising:

a base including first and second base supports and locking bars disposed between the base supports, wherein each of the first and second base supports includes:

a straight bar;

a plurality of holes, which are located on an outside face of the straight bar;

a pair of bolts, wherein the pair of bolts are movably engageable with the plurality of holes;

at least one handle adjustably coupled to at least one of the first and second base supports;

a footboard including a platform and at least one platform support;

a footboard support, wherein the footboard support is rotatably attached to the footboard, and wherein the footboard support includes a pair of support arms, wherein the pair of support arms are rotatably attached to the footboard at a proximal end, and each having a concave cutout at a corresponding distal end;

wherein the concave cutouts of each of the pair of support arms engage with one of the locking bars to maintain the footboard stationary at a selected angle during operation;

a pair of handles, wherein each of the pair of handles is attached to a respective one of the first and second base supports; and wherein the base, the footboard, and the footboard support are fully collapsible so that the exercise apparatus is portable for transport by the user.

18. The exercise apparatus of claim 17, further comprising a hip belt including:

a strap having first and second ends; and at least one resistance band attached to at least one of the first and second ends, and wherein the hip belt is adjustably coupled to at least one of the base and the platform.

19. The exercise apparatus of claim 17, further comprising an elastic band placed around the user's legs to increase resistance on different muscles during use of the exercise apparatus.

* * * * *